US007568938B2

(12) United States Patent
Siev et al.

(10) Patent No.: US 7,568,938 B2
(45) Date of Patent: Aug. 4, 2009

(54) BALANCED INTERCONNECTOR

(75) Inventors: Virak Siev, Pointe-Claire (CA); Antoine Pelletier, Ville Lasalle (CA)

(73) Assignee: Belden CDT (Canada) Inc., Saint-Laurent (CA)

( * ) Notice: Subject to any disclaimer, the term of this patent is extended or adjusted under 35 U.S.C. 154(b) by 0 days.

(21) Appl. No.: 12/187,671

(22) Filed: Aug. 7, 2008

(65) Prior Publication Data

US 2008/0293289 A1 Nov. 27, 2008

Related U.S. Application Data

(60) Division of application No. 11/740,154, filed on Apr. 25, 2007, now Pat. No. 7,422,467, which is a continuation-in-part of application No. PCT/CA2005/001753, filed on Nov. 17, 2005.

(60) Provisional application No. 60/628,136, filed on Nov. 17, 2004.

(30) Foreign Application Priority Data

Nov. 17, 2004 (CA) ..... 2487760
Apr. 25, 2006 (CA) ..... 2544929

(51) Int. Cl.
*H01R 4/24* (2006.01)

(52) U.S. Cl. ..... 439/404; 439/941

(58) Field of Classification Search ..... 439/403, 439/404, 405, 676, 941
See application file for complete search history.

(56) References Cited

U.S. PATENT DOCUMENTS 4,295,703 A 10/1981 Osborne
5,186,647 A 2/1993 Denkmann et al.
5,536,182 A 7/1996 Atoh et al.
5,967,853 A 10/1999 Hashim
5,997,358 A 12/1999 Adriaenssens et al.
6,045,391 A 4/2000 Jaag
6,116,965 A 9/2000 Arnett et al.
6,126,476 A 10/2000 Viklund et al.
6,150,612 A 11/2000 Grandy et al.
6,193,526 B1 2/2001 Milner et al.
6,238,231 B1 5/2001 Chapman et al.
6,270,381 B1 8/2001 Adriaenssens et al.
6,280,231 B1 8/2001 Nicholls
6,309,240 B1 10/2001 Daoud
6,582,247 B2 6/2003 Siemon (Continued)

FOREIGN PATENT DOCUMENTS

CA 1176330 B1 10/1984

(Continued)

*Primary Examiner*—Khiem Nguyen
(74) *Attorney, Agent, or Firm*—Goudreau Gage Dubuc

(57) ABSTRACT

There is disclosed a balanced interconnector comprising first and second like connecting elements, each of the connecting elements comprising an elongate centre section and a pair of parallel IDCs opening in substantially opposite directions, the IDCs attached substantially at right angles to and at opposite ends of the elongate centre sections, each of the connecting elements lying in different parallel plains. The first and second connecting elements are arranged such that the elongate centre sections are opposite one another and the IDCs of the first connecting element are not opposite the IDCs of the second connecting element. In a particular embodiment the connecting elements of adjacent pairs of connecting elements are at right angles.

17 Claims, 18 Drawing Sheets

U.S. PATENT DOCUMENTS

| | | | |
|---|---|---|---|
| 6,592,395 | B2 | 7/2003 | Brown et al. |
| 6,596,944 | B1 | 7/2003 | Clark et al. |
| 6,641,411 | B1 | 11/2003 | Stoddard et al. |
| 6,648,670 | B1 | 11/2003 | Chen |
| 6,794,570 | B2 | 9/2004 | Chou |
| 7,166,000 | B2 | 1/2007 | Pharney |
| 7,168,993 | B2 | 1/2007 | Hashim |
| 7,179,115 | B2 | 2/2007 | Hashim |
| 7,186,148 | B2 | 3/2007 | Hashim |
| 7,186,149 | B2 | 3/2007 | Hashim |
| 7,190,594 | B2 | 3/2007 | Hashim et al. |
| 7,201,618 | B2 | 4/2007 | Ellis et al. |
| 7,204,722 | B2 | 4/2007 | Hashim et al. |
| 7,223,115 | B2 | 5/2007 | Hashim et al. |
| 7,264,516 | B2 | 9/2007 | Hashim et al. |
| 7,314,393 | B2 | 1/2008 | Hashim |
| 7,320,624 | B2 | 1/2008 | Hashim et al. |
| 7,322,847 | B2 | 1/2008 | Hashim et al. |
| 7,326,089 | B2 | 2/2008 | Hashim |
| 7,503,798 | B2 | 3/2009 | Hashim |
| 2005/0136729 | A1 | 6/2005 | Redfield et al. |
| 2005/0195584 | A1 | 9/2005 | AbuGhazaleh et al. |
| 2006/0154531 | A1 | 7/2006 | Kim et al. |
| 2006/0160428 | A1 | 7/2006 | Hashim |
| 2006/0292920 | A1 | 12/2006 | Hashim et al. |

FOREIGN PATENT DOCUMENTS

| | | | |
|---|---|---|---|
| CA | 2486596 | A1 | 5/2005 |
| EP | 0 899 827 | A2 | 3/1999 |
| FR | 2 600 825 | A1 | 7/2006 |
| JP | 11233205 | | 8/1999 |
| WO | WO-98/13899 | A | 4/1998 |
| WO | WO-99/03172 | A | 1/1999 |
| WO | WO-02/15339 | A1 | 2/2002 |
| WO | WO-2005/117200 | A1 | 12/2005 |
| WO | WO-2006/132972 | A1 | 12/2006 |

BALANCED INTERCONNECTOR

CROSS REFERENCE TO RELATED APPLICATIONS

This application is a Divisional application of U.S. patent application Ser. No. 11/740,154, filed Apr. 25, 2007, now U.S. Pat. No. 7,422,467 which is itself a Continuation-In-Part (CIP) application of PCT Application No. PCT/CA2005/001753 filed on Nov. 17, 2005 designating the United States and published in English under PCT Article 21(2), which itself claims priority on U.S. Provisional Application No. 60/628,136 filed on Nov. 17, 2004 and Canadian Patent Application No. 2,487,760 also filed on Nov. 17, 2004.

This application also claims priority on U.S. Provisional Application No. 60/745,563 filed on Apr. 25, 2006 and Canadian Patent Application No. 2,544,929 also filed on Apr. 25, 2006.

All documents cited above are herein incorporated by reference.

BACKGROUND

In data transmission networks, cross-connect connectors (such as BIX, 110, 210, etc.) are commonly used in telecommunication rooms to interconnect the ends of telecommunications cables, thereby facilitating network maintenance. For example, the prior art reveals cross connectors comprised of a series of isolated flat straight conductors each comprised of a pair of reversed Insulation Displacement Contact (IDC) connectors connected end to end for interconnecting a conductor of a first cable with the conductors of a second cable.

As known in the art, all conductors transmitting signals act as antennas and radiate the signal they are carrying into their general vicinity. Other receiving conductors will receive the radiated signals as crosstalk. Cross talk typically adversely affects signals being carried by the receiving conductor and must be dealt with if the strength of the received crosstalk exceeds certain predetermined minimum values. The strength of received cross talk is dependant on the capacitive coupling between the transmitting conductor and the receiving conductor which is influenced by a number of mechanical factors, such as conductor geometry and spacing between the conductors, as well the frequency of the signals being carried by the conductors, shielding of the conductors, etc. As signal frequency increases, the influence of even quite small values of capacitive coupling can give rise to significant cross talk having a deleterious effect on signal transmission.

Systems designed for the transmission of high frequency signals, such as the ubiquitous four twisted pair cables conforming to ANSI/EIA 568, take advantage of a variety of mechanisms to minimise the capacitive coupling between conductors both within and between cables. One problem with such systems is that, although coupling, and therefore crosstalk, is reduced within the cable runs, conductors within the cables must inevitably be terminated, for example at device or cross connector. These terminations introduce irregularities into the system where coupling, and therefore cross talk, is increased. With the introduction of Category 6 and Augmented Category 6 standards and the 10 GBase-T transmission protocol, the allowable levels for all kinds of internal and external crosstalk, including Near End Crosstalk (NEXT), Far End Crosstalk (FEXT) and Alien Crosstalk, have been lowered. As a result, the prior art connectors and interconnectors are generally no longer able to meet the allowable levels for cross talk.

Additionally, although long cable elements such as the twisted pairs of conductors achieve good crosstalk characteristics through appropriate twisting and spacing of the pairs of conductors, when viewed as a whole, the cable is subject to additional crosstalk at every irregularity. Such irregularities occur primarily at connectors or interconnectors and typically lead to an aggressive generation of crosstalk between neighbouring pairs of conductors which in turn degrades the high frequency bandwidth and limits data throughput over the conductors. As the transmission frequencies continue to increase, each additional irregularity at local level, although small, adds to a collective irregularity which may have a considerable impact on the transmission performance of the cable. In particular, unraveling the ends of the twisted pairs of conductors in order to introduce them into an IDC type connections introduces capacitive coupling between the twisted pairs.

SUMMARY OF THE INVENTION

In order to address the above and other drawbacks, there is provided a method of interconnecting first and second conductors of a first pair of conductors respectively with first and second conductors of a second pair of conductors and first and second conductors of a third pair of conductors respectively with first and second conductors of fourth second pair of conductors, the second conductor of the first pair of conductors coupled by a first parasitic capacitance to the first conductor of the third pair of conductors and the first conductor of the second pair of conductors coupled by a second parasitic capacitance to the second conductor of the fourth pair of conductors, wherein the first and second parasitic capacitances are substantially the same. The method comprises providing first and second interconnecting elements, providing a first capacitor having a capacitive value substantially the same as the parasitic capacitances, coupling the first and second elements with the first capacitor, interconnecting the first element between the first conductor of the first pair of conductors and the first conductor of the second pair of conductors and the second element between the first conductor of the third pair of conductors and the first conductor of the fourth pair of conductors, providing third and fourth interconnecting elements, providing a second capacitor having a capacitive value substantially the same as the parasitic capacitances, coupling the third and fourth elements with the second capacitor, interconnecting the third element between the second conductor of the first pair of conductors and the second conductor of the second pair of conductors and the fourth element between the second conductor of the third pair of conductors and the second conductor of the fourth pair of conductors.

Additionally, there is disclosed an interconnector for interconnecting first and second conductors of a first pair of conductors with first and second conductors of a second pair of conductors and first and second conductors of a third twisted pair of conductors with first and second conductors of a fourth twisted pair of conductors, the second conductor of the first pair of conductors coupled by a first parasitic capacitance to the first conductor of the third pair of conductors and the first conductor of the second pair of conductors coupled by a second parasitic capacitance to the second conductor of the fourth pair of conductors, wherein the first and second parasitic capacitances are substantially the same. The interconnector comprises first and second Tip elements, the first Tip element interconnected between the first conductor of the first pair of conductors and the first conductor of the second pair of conductors and the second Tip element interconnected between the first conductor of the third pair of conductors and the first conductor of the fourth pair of conductors, first and second Ring elements, the first Ring element interconnected between the second conductor of the first pair of conductors and the second conductor of the second pair of conductors and the second Ring element interconnected between the second conductor of the third pair of conductors and the second conductor of the fourth pair of conductors, and first and second capacitors between respectively the first and second Tip elements and the first and second Ring elements. Each of the capacitors is substantially equal to the first and second parasitic capacitances.

BRIEF DESCRIPTION OF THE FIGURES

FIG. 12(*b*) is a schematic diagram of the parasitic capacitances arising with the connecting elements of FIG. 12(*a*);

FIG. 12(*c*) is a schematic diagram of the parasitic capacitances arising between all the connecting elements within an interconnector in accordance with an alternative illustrative embodiment of the present invention;

FIG. 13(*b*) is a schematic diagram of the inherent capacitances of FIG. 13(*a*);

FIG. 14(*b*) is a top plan view detailing the relative placement of the connecting elements of adjacent interconnectors in accordance with an alternative illustrative embodiment of the present invention.

DETAILED DESCRIPTION OF THE ILLUSTRATIVE EMBODIMENTS

Figure 1:
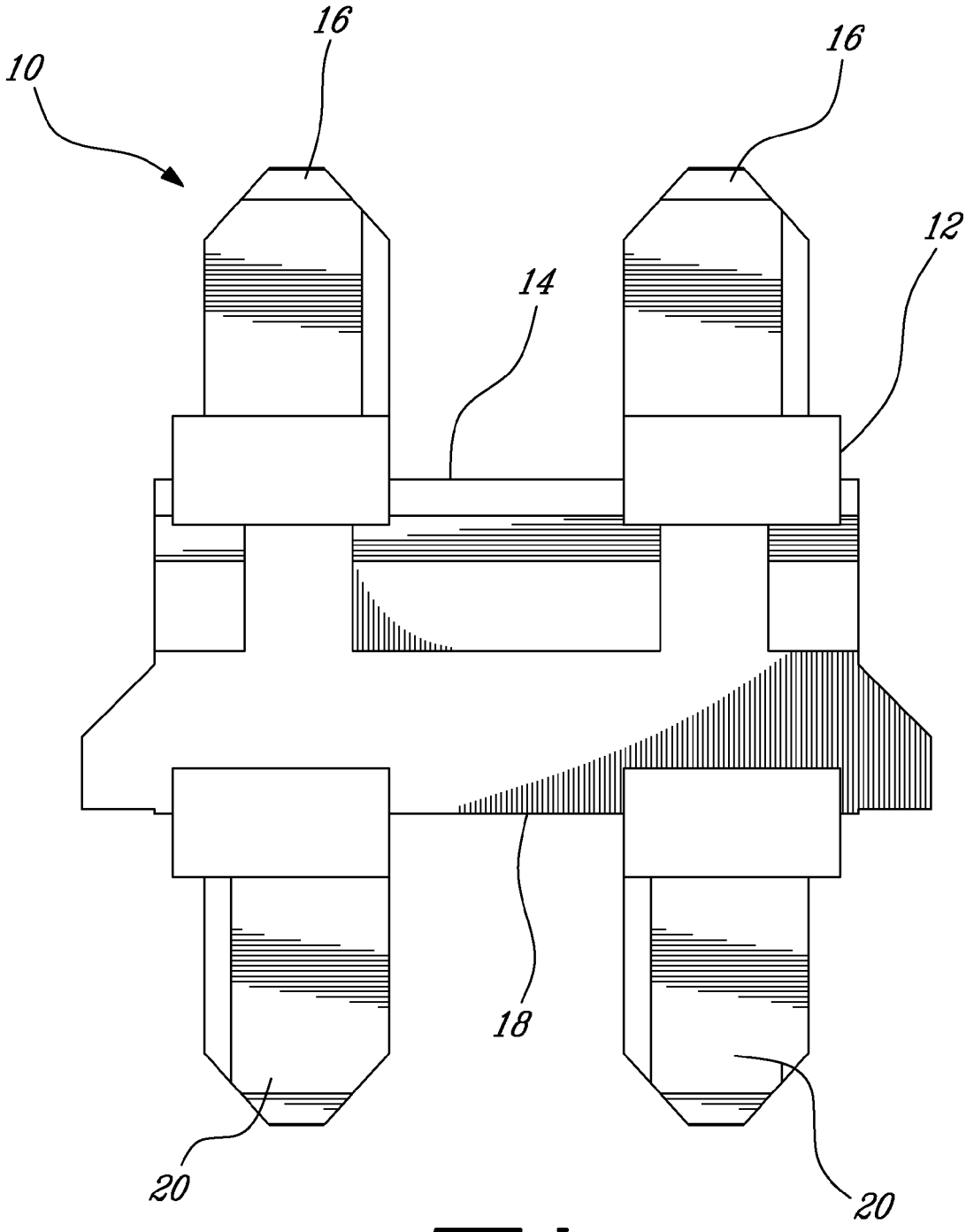
FIG. 1 is a side plan view of a balanced interconnector in accordance with an illustrative embodiment of the present invention.
Figure 2:
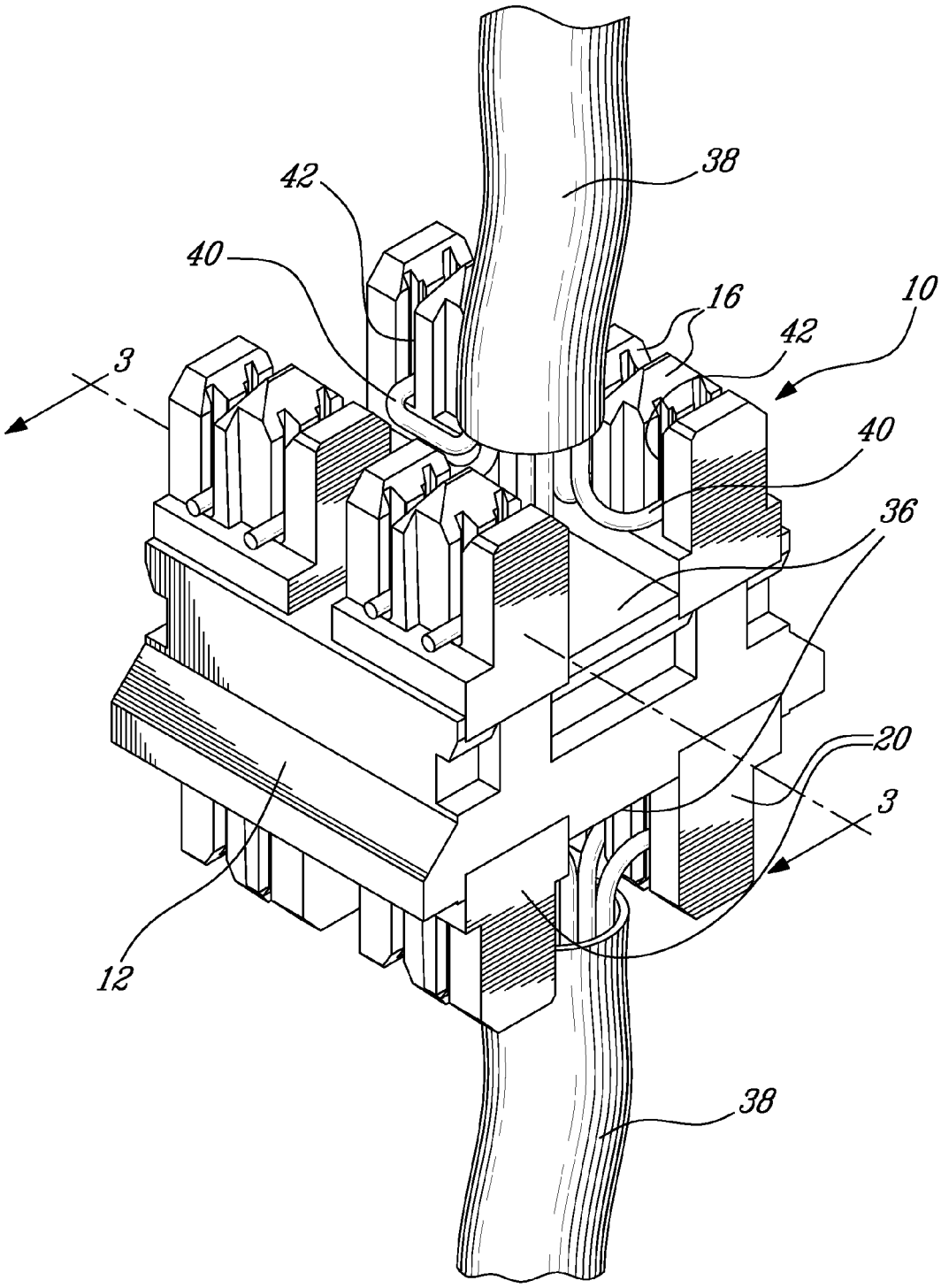
FIG. 2 is a right raised perspective view of a balanced interconnector in accordance with an illustrative embodiment of the present invention.

Referring now to FIGS. 1 and 2, a balanced interconnector, generally referred to using the reference numeral 10, will now be described. The interconnector 10 comprises an insulating housing 12 comprising a first outer surface 14 into which a first set of turrets as in 16 are moulded and a second outer surface 18 into which a second set of turrets as in 20 are moulded. Note that although first outer surface 14 and the second outer surface 18 are shown as being relatively flat and opposed, in a particular embodiment the surfaces could be at an angle to one another, or could be of uneven height such that the turrets as in 16, 20 have different relative heights.

Figure 3:
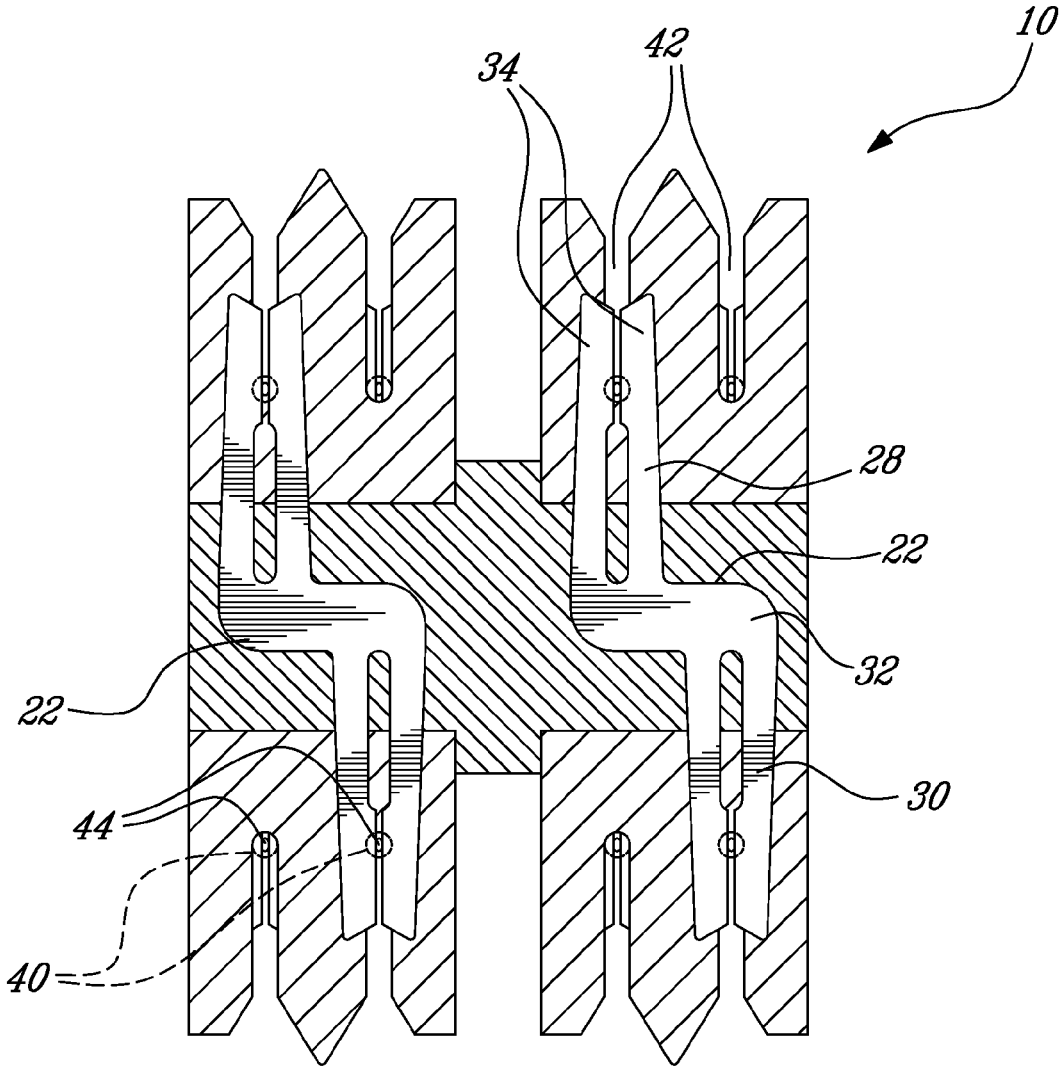
FIG. 3 is a sectional view of a balanced interconnector taken along line 3-3 in FIG. 2.
Figure 4:
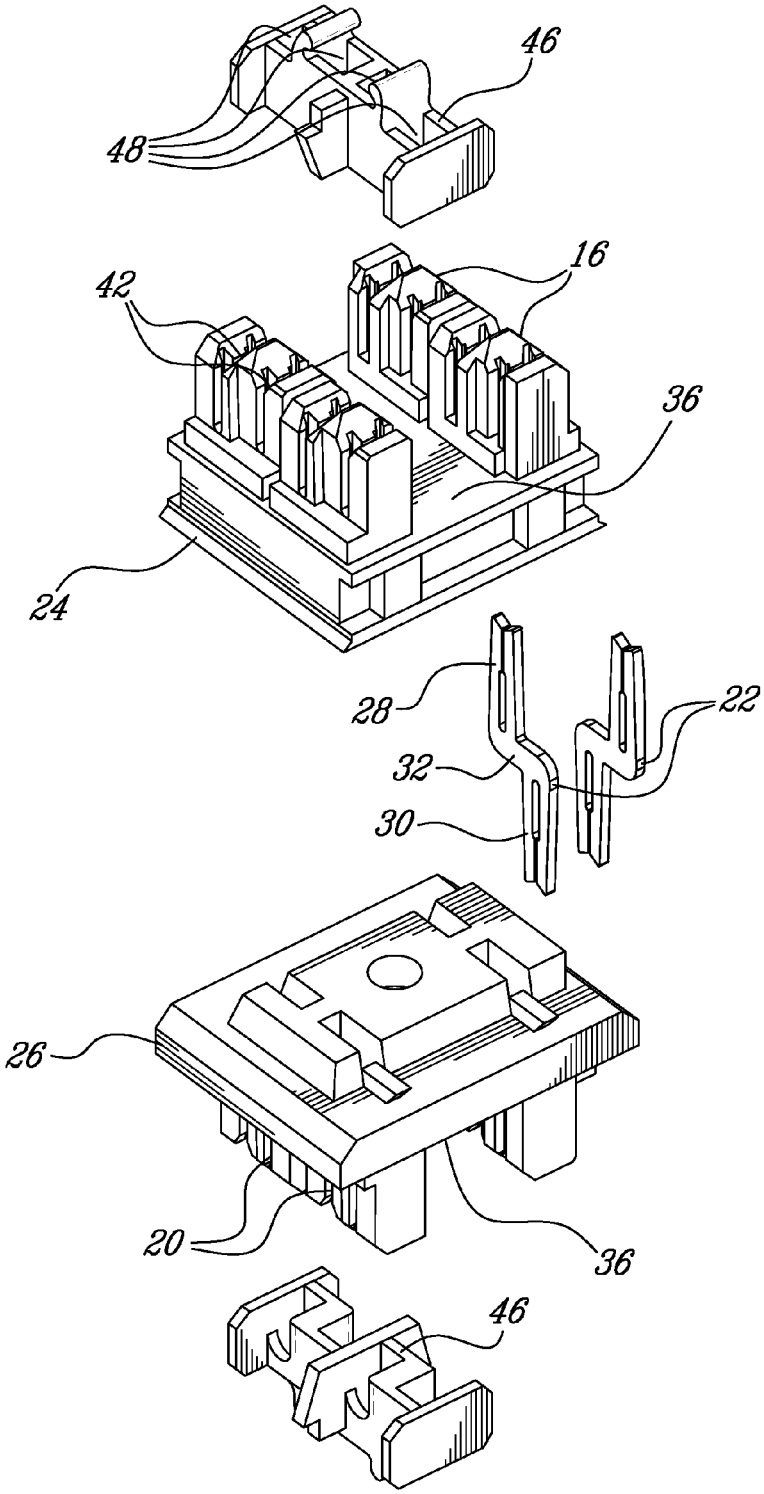
FIG. 4 is an exploded view of a balanced interconnector in accordance with an illustrative embodiment of the present invention.

Referring now to FIGS. 3 and 4 in addition to FIGS. 1 and 2, a series of connecting elements as in 22 which extend from one of the first set of turrets as in 16 to a corresponding one of the second set of turrets as in 20 are imbedded in the housing 12. In this regard, the housing 12 is typically manufactured in first and second interconnecting parts 24, 26 thereby providing a simple means for assembling the connecting elements as in 22 within the housing 12. Each connecting element 22 is comprised of a pair of opposed terminals 28, 30, Illustratively elongate with each terminal arranged along parallel non-collinear axes. The terminals 28, 30 are illustratively bifurcated Insulation Displacement Connectors (IDCs), interconnected by an elongate connecting portion 32 at an angle to the terminals as in 28, 30. Illustratively, the angle between the terminals 28, 30 and the elongate connecting portion 32 is shown as being a right angle.

As known in the art, the IDCs as in 28, 30 are each comprised of a pair of opposed insulation displacing blades as in 34. Each connecting element 22 is illustratively stamped from a flat conducting material such as nickel plated steel, although in a particular embodiment the connecting element 22 could be formed in a number of ways, for example as an etched trace on a Printed Circuit Board (PCB) or the like.

Still referring to FIGS. 1 through 4, the first set of turrets as in 16 and the second set of turrets as in 20 are each arranged in two parallel rows of turrets defining a cable end receiving region 36 there between for receiving a cable end 38. The insulated conductors as in 40 (typically arranged in twisted pairs of conductors) exit the cable end 38 and are received by conductor receiving slots 38 moulded in each of the turrets as in 16 or 20. As known in the art, the insulated conductors as in 40 are inserted into their respective slots as in 42 using a special "punch down" tool (not shown) which simultaneously forces the conductor as in 40 between the bifurcated IDC, thereby interconnecting the conductive centre 44 of the insulated conductor 34 with the IDC as in 24, 26, while cutting the end of the conductor 40 (typically flush with the outer edge of the turret in question).

As known in the art, the insulated conductors as in 40 are typically arranged into colour coded twisted pairs of conductors, and often referred to as Tip and Ring. In twisted pair wiring, the non-inverting wire of each pair is often referred to as the Ring and comprises an outer insulation having a solid colour, while the inverting wire is often referred to as the Tip and comprises a white outer insulation including a coloured stripe.

Figure 5:
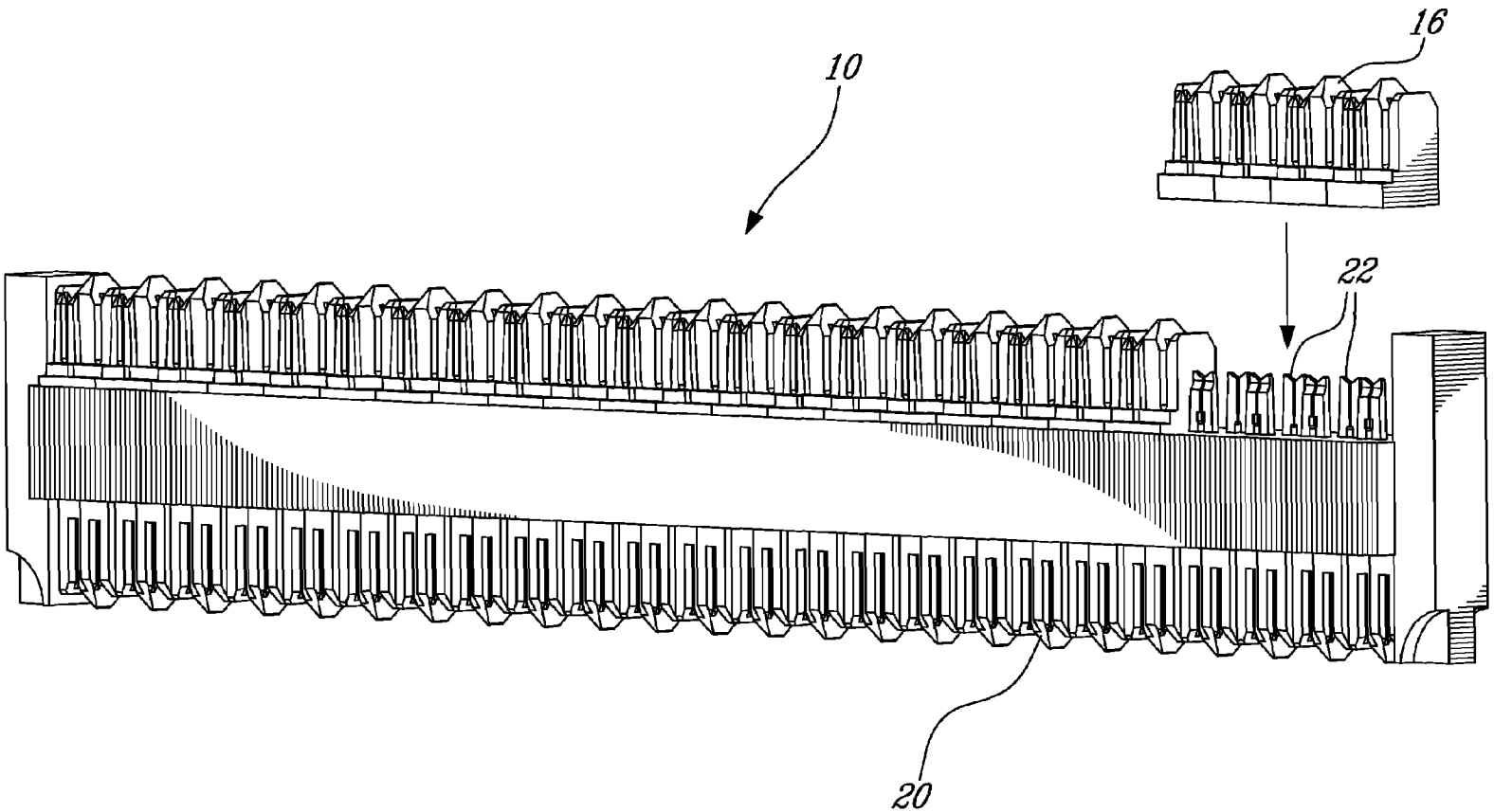
FIG. 5 is a partially disassembled right front perspective view of a balanced interconnector in accordance with an alternative illustrative embodiment of the present invention.

Note that although the first set of turrets 16 and the second set of turrets as in 20 in the above illustrative embodiment are each shown as being arranged in two (2) parallel rows of turrets, in a particular embodiment the first set of turrets 16 and the second set of turrets as in 20 could be arranged in a single row, alternatively also together with others, to form the inline cross connector as illustrated in FIG. 5. Additionally, systems other than IDCs could be used for interconnecting the insulated conductors as in 40 with their respective connecting elements as in 22.

Referring now to FIGS. 2 and 4, in a particular embodiment a wire lead guide as in 46, comprised of a plurality of conductor guiding channels as in 48 moulded therein and adapted to fit snugly into the cable end receiving regions as in 36, can be interposed between the cable end 38 and the conductor receiving slots 42 moulded in each of the turrets as in 16 or 20.

Figure 6:
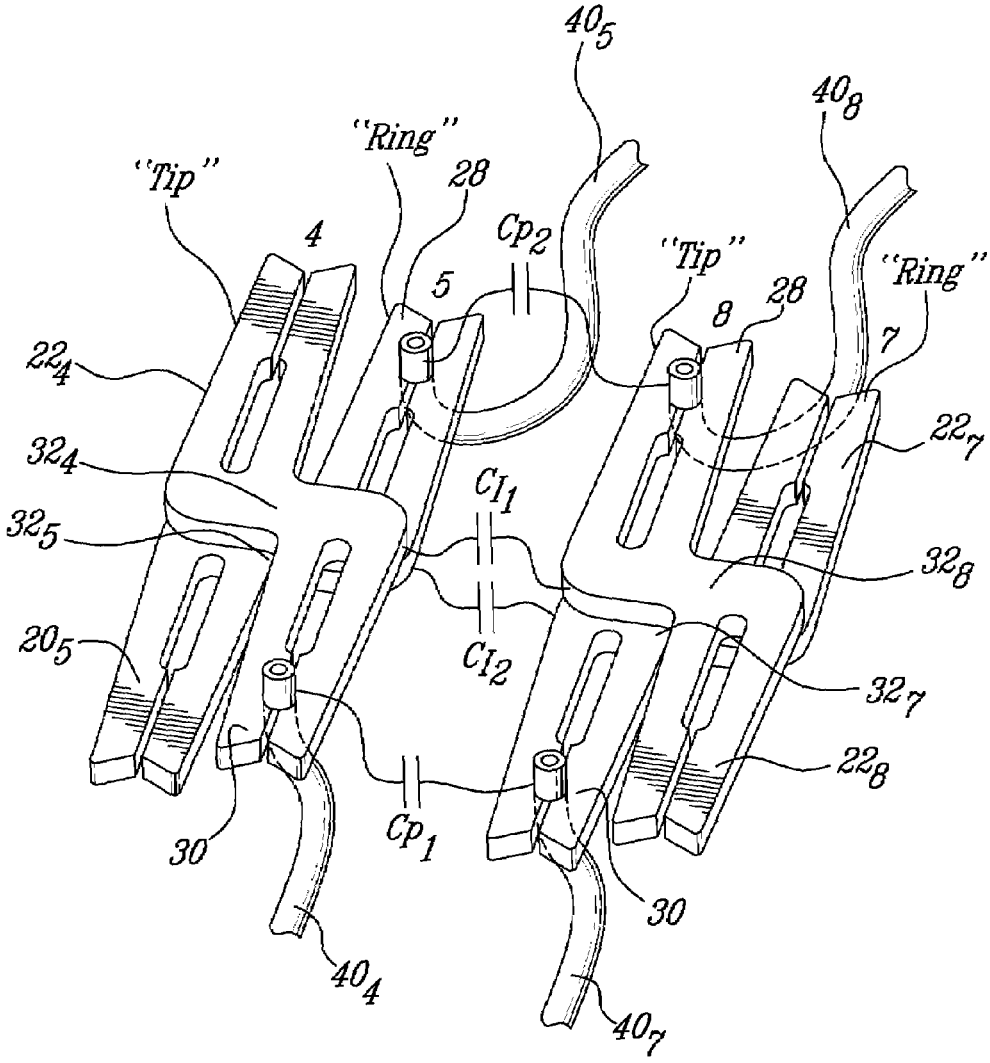
FIG. 6 is right lowered perspective view of two pairs of connecting elements in accordance with an illustrative embodiment of the present invention.

Referring now to FIGS. 2 and 6, as discussed above the first set of turrets as in 16 and the second set of turrets as in 20 are each arranged in two parallel rows of turrets. As a result, four (4) connecting elements as in 22 are illustratively arranged on each side of the cable end receiving region 36, each comprising two (2) pairs of interconnectors. Illustratively, on a first side of the cable end receiving region 36 four (4) connecting elements $\mathbf{22}_4$, $\mathbf{22}_8$ and $\mathbf{22}_5$, $\mathbf{22}_7$ each terminate a respective conductor as in 44 (illustratively the interconnectors are indicated as terminating conductors 4, 8, 5 and 7 of the twisted pairs of conductors).

Figure 7:
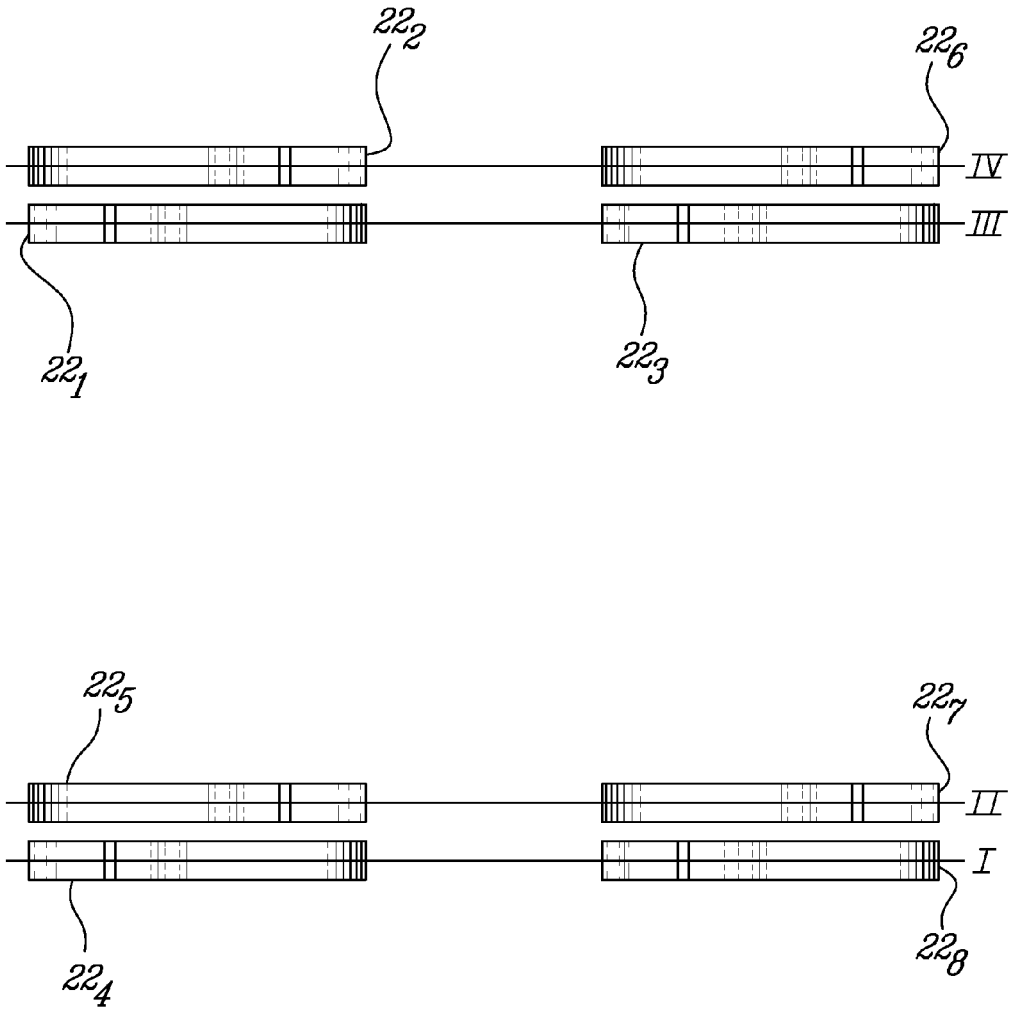
FIG. 7 is a top plan view of four pairs of connecting elements in accordance with an illustrative embodiment of the present invention.
Figure 8:
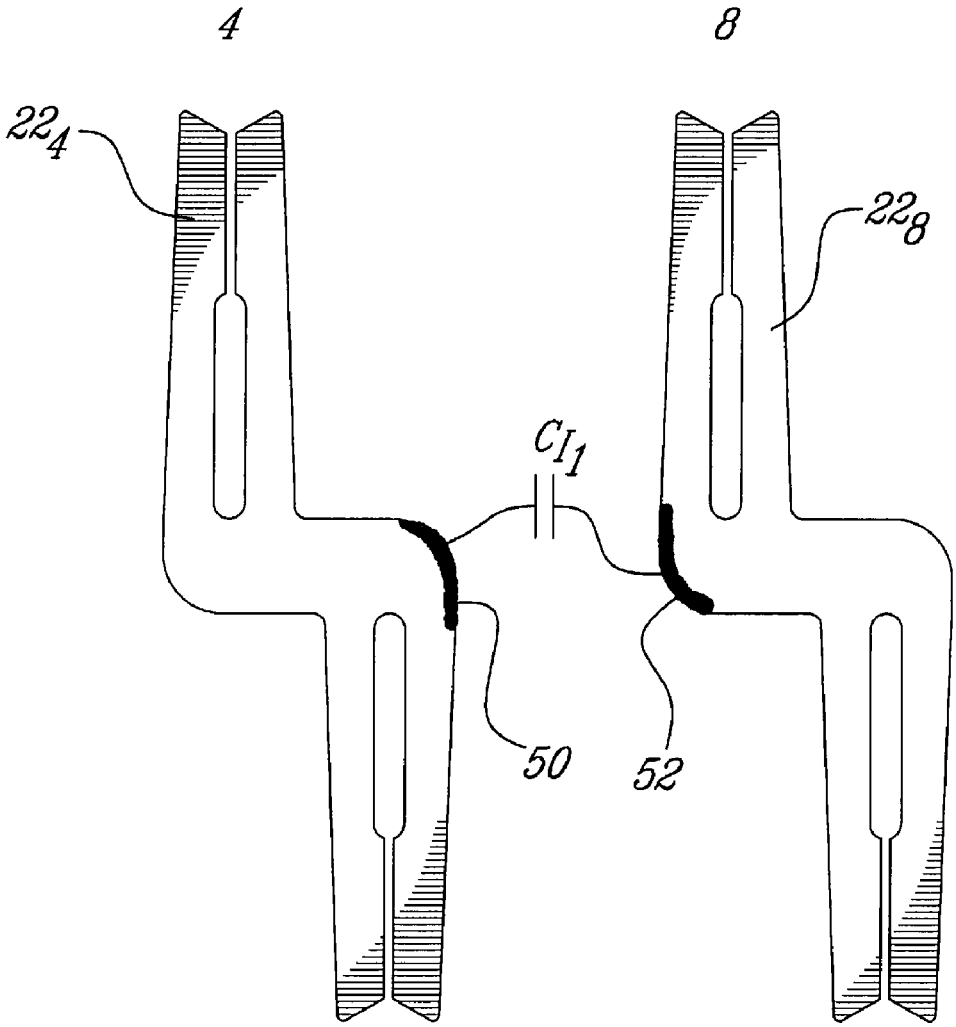
FIG. 8 is a side plane view of a pair of adjacent connecting elements in accordance with an illustrative embodiment of the present invention.

Referring now to FIG. 7, the "Tip" connecting elements $\mathbf{22}_4$, $\mathbf{22}_8$ of each interconnector pair lie in a first plane "I" and the "Ring" connecting elements $\mathbf{22}_5$, $\mathbf{22}_7$ lie in a second plane "II". Similarly, the "Tip" connecting elements $\mathbf{22}_1$, $\mathbf{22}_3$ each lie in a third plane "III" and the "Ring" connecting elements $\mathbf{22}_2$, $\mathbf{22}_6$ lie in a fourth plane "IV" parallel to yet displaced from the first plain. All planes are parallel and displaced from one another. Note that, notwithstanding the above designation of certain connecting elements as in 22 being Tip elements and others being Rings elements, a person of skill in the art will understand that a Tip element of a Tip and Ring pair could be used to terminate either a Ring or Tip of a conductor pair with the Ring element of the Tip and Ring pair terminating the other.

Referring back to FIG. 6 in addition to FIG. 7, the direction of the elongate connecting portions $\mathbf{32}_4$, $\mathbf{32}_8$ of the first pair of connecting elements $\mathbf{22}_4$, $\mathbf{22}_8$ is opposite to that of the elongate connecting portion $\mathbf{32}_5$, $\mathbf{32}_7$ of the second pair of connecting elements $\mathbf{22}_5$, $\mathbf{22}_7$ such that the Tip and Ring connecting elements terminating a given twisted pair are arranged opposite one another as a reverse mirror image.

Still Referring to FIGS. 6 and 7, although the connecting elements as in 22 are not interconnected directly with one another, given the relative proximity of adjacent connecting elements as in 22 to one another, unraveling the ends of the cables 38 in order to insert the conductors as in 40 into their respective IDCs as in 28, 30 gives rise to a parasitic coupling (illustrated by capacitive elements $C_{P1}$ and $C_{P2}$) between the conductors as in 40, with the effect being the greatest for those which are closest (illustratively conductors marked 4-7 and conductors marked 5-8). As known in the art, especially at high frequencies such coupling, although small, can have a large detrimental effect on a transmitted signal. In particular, in the illustrated case differential signals travelling on the pair of conductors marked 7-8 give rise to differential signals on the pair of conductors marked 4-5 and vice versa. The is effect is counteracted by the positioning of the interconnectors in the manner shown which gives rise to an inherent coupling (illustrated by first and second capacitive elements $C_{I1}$ and $C_{I2}$) between connecting elements as in 22 lying in the same plane. Indeed, referring to the first capacitive element $C_{I1}$, for example, an outer edge 50 of connecting element $\mathbf{22}_4$ provides a first electrode of the first capacitive element $C_{I1}$, an outer edge 52 of connecting element $\mathbf{22}_8$ provides a second electrode of the first capacitive element $C_{I1}$ and air in between the two electrodes 50, 52 provides the dielectric material of the first capacitive element $C_{I1}$.

The inherent capacitances $C_{I1}$ and $C_{I2}$ effectively cancel the differential mode signals that would otherwise be induced in the pair of conductors $\mathbf{40}_4$ and $\mathbf{40}_5$ by the pair of conductors $\mathbf{40}_7$ and $\mathbf{40}_8$ and vice versa.

Figure 9:
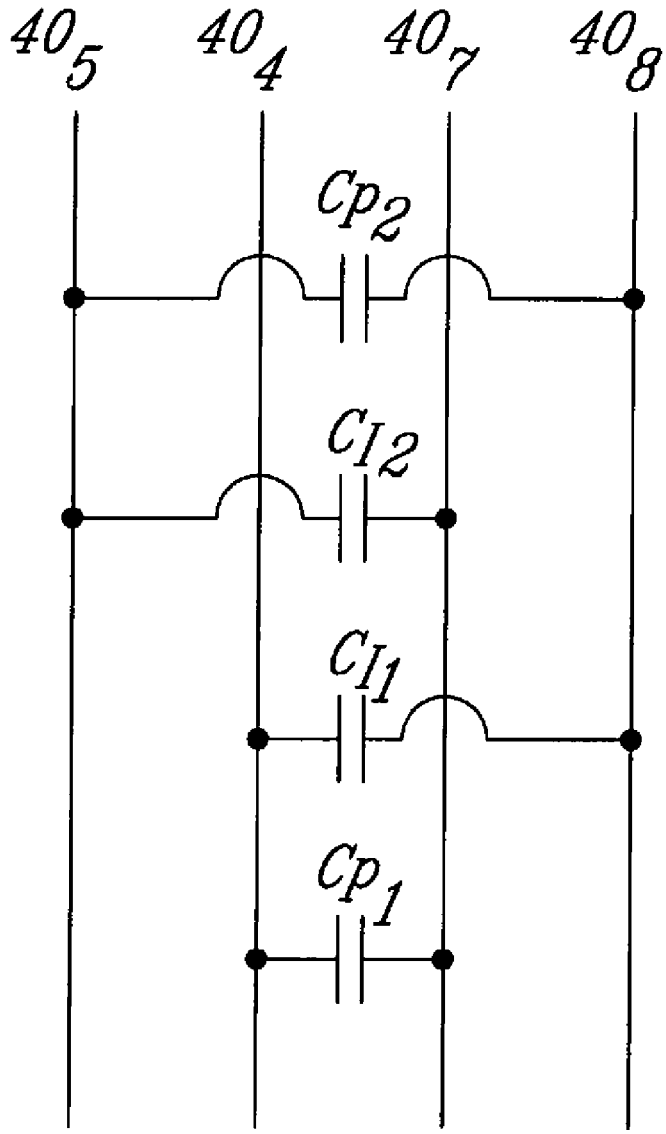
FIG. 9 is a schematic diagram of the coupling effect in accordance with an illustrative embodiment of the present invention.

This effect is illustrated in the capacitive network as shown in FIG. 9, where both components of the differential signal on the conductors $\mathbf{40}_7$ and $\mathbf{40}_8$ is coupled into each of the conductors $\mathbf{40}_4$ and $\mathbf{40}_5$, thereby effectively cancelling out the differential signal. In this manner, the inherent capacitors cancel crosstalk introduced into the conductors $\mathbf{40}_4$, $\mathbf{40}_5$, $\mathbf{40}_7$ and $\mathbf{40}_8$ terminated by, referring to FIG. 6 in addition to FIG. 9, the connecting elements as in 22 by the necessary unraveling of the twisted pairs of conductors 40 in order to insert their ends into the bifurcated IDCs 28, 30.

Figure 10:
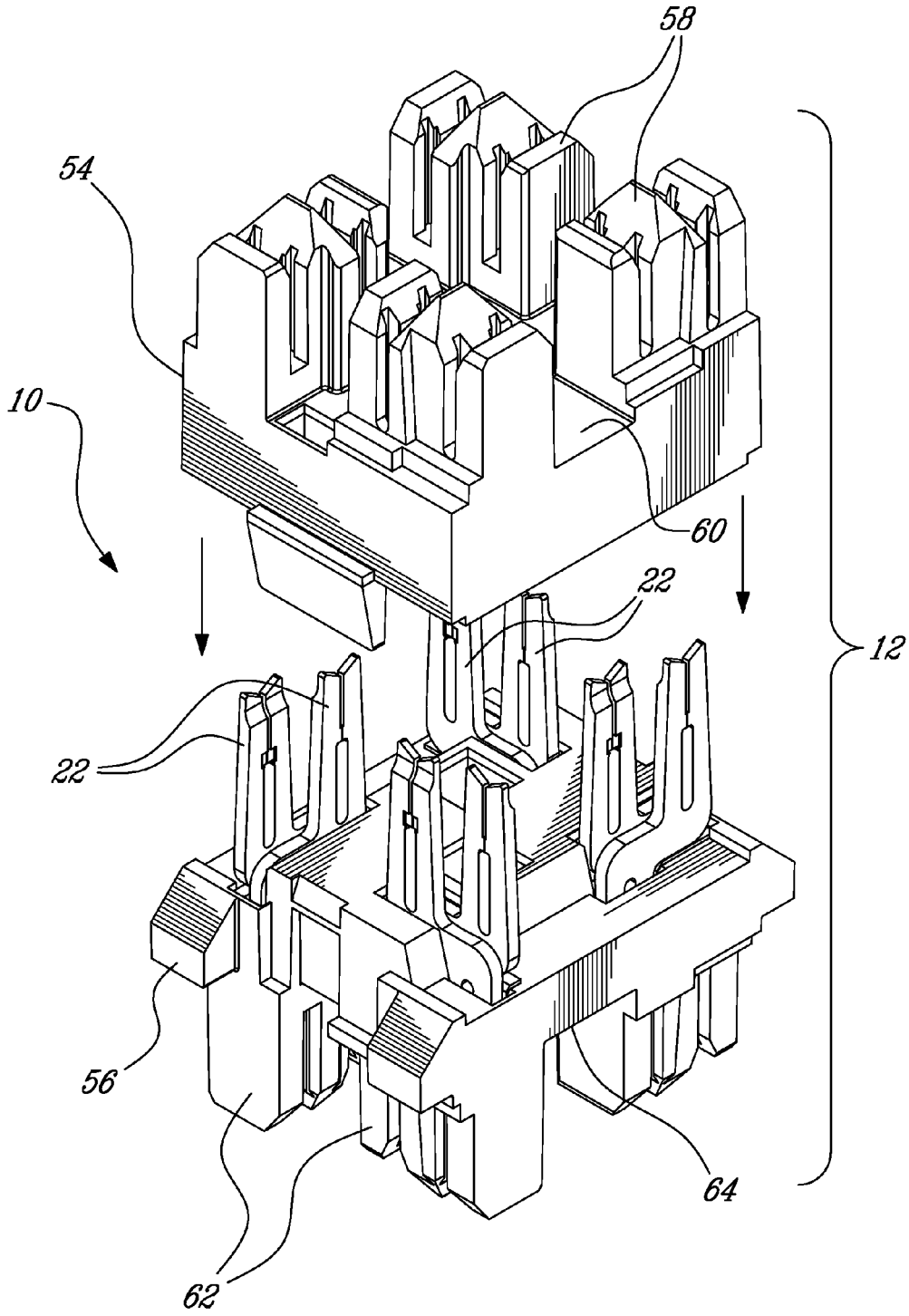
FIG. 10 is an exploded view of a balanced interconnector in accordance with an alternative illustrative embodiment of the present invention.

Referring now to FIG. 10, in an alternative illustrative embodiment of the present invention, the cross connector 10 is comprised of a housing 12 manufactured in first and second interconnecting parts 54, 56. The first interconnecting part 54 further comprises a series of turrets as in 58 illustratively arranged at the corners of the outer surface 60 of the first interconnecting part 54. Similarly, the second interconnecting part 56 also comprises a series of turrets as in 62 illustratively arranged at the corners of the outer surface 64 of the second interconnecting part 54. The substantially flat connecting elements as in 22 are arranged in pairs such that adjacent connecting elements as in 22 have their flat sides at right angles to one another. In other aspects, the alternative illustrative embodiment is similar to the first illustrative embodiment as described in detail hereinabove.

Figure 11:
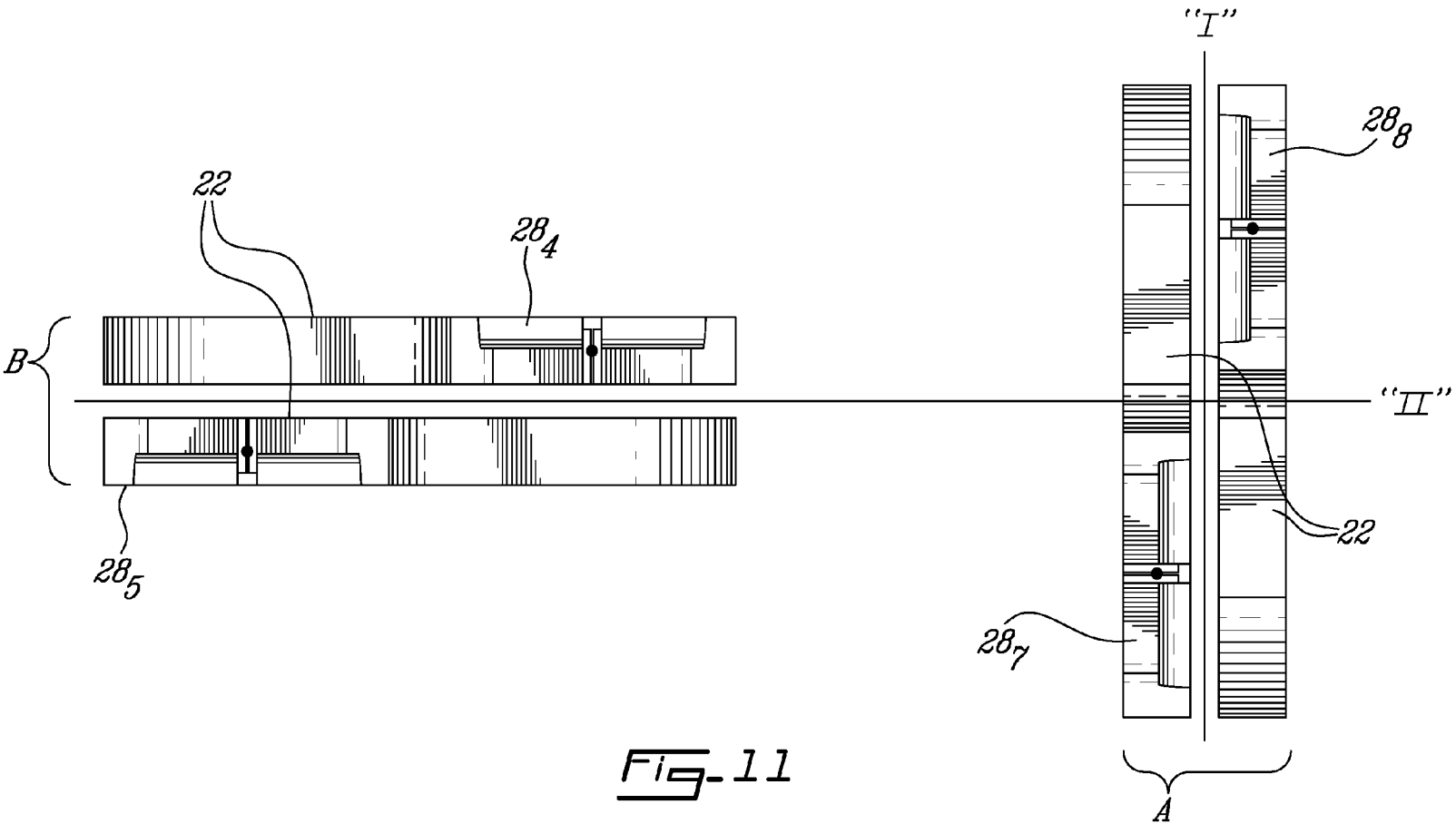
FIG. 11 is a top plan view of two pairs of connecting elements in accordance with an alternative illustrative embodiment of the present invention.

Referring now to FIG. 11, a first pair "A" of substantially flat connecting elements 22 are arranged on either side and parallel to a plane "I". Additionally, a second pair "B" of substantially flat connecting elements 22 are arranged on either side and parallel to a plane "II" which intersects plane "I" at right angles. Preferably plane "II" intersects plane "I" along a line which is coincident with the centres of the first pair A of connecting elements 22, although in a particular embodiment the line of intersection could be coincident with another point other than the centre. This configuration is repeated for all four (4) pairs of connecting elements as in 22, that is each pair of connecting elements as in 22 is positioned at right angles to the adjacent pairs of connecting elements as in 22. As a result, each pair of connecting elements lies on either side of a plane which intersects that of an adjacent pair of connecting elements as in 22 and is in turn intersected by that of the other adjacent pair of connecting elements as in 22.

Figure 12A:
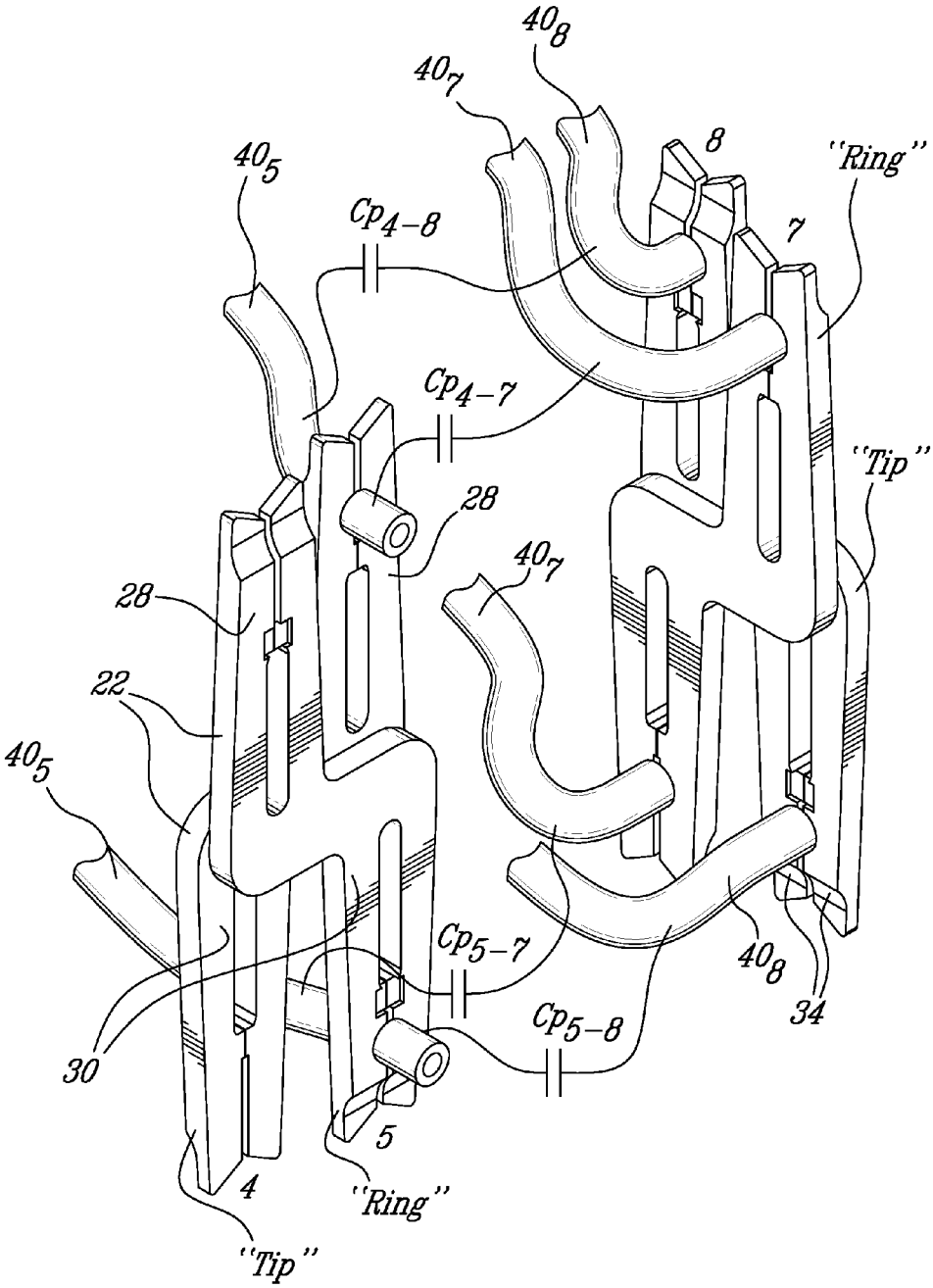
FIG. 12(*a*) is a left raised perspective view of two pairs of interconnectors in accordance with an alternative illustrative embodiment of the present invention.
Figure 12B:
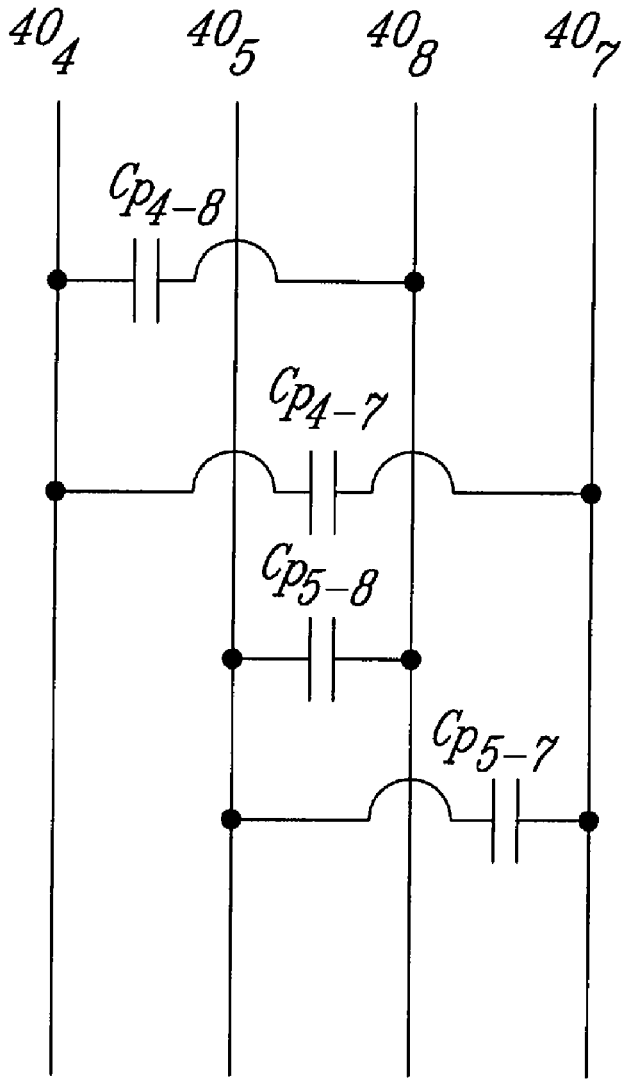
Figure 12C:
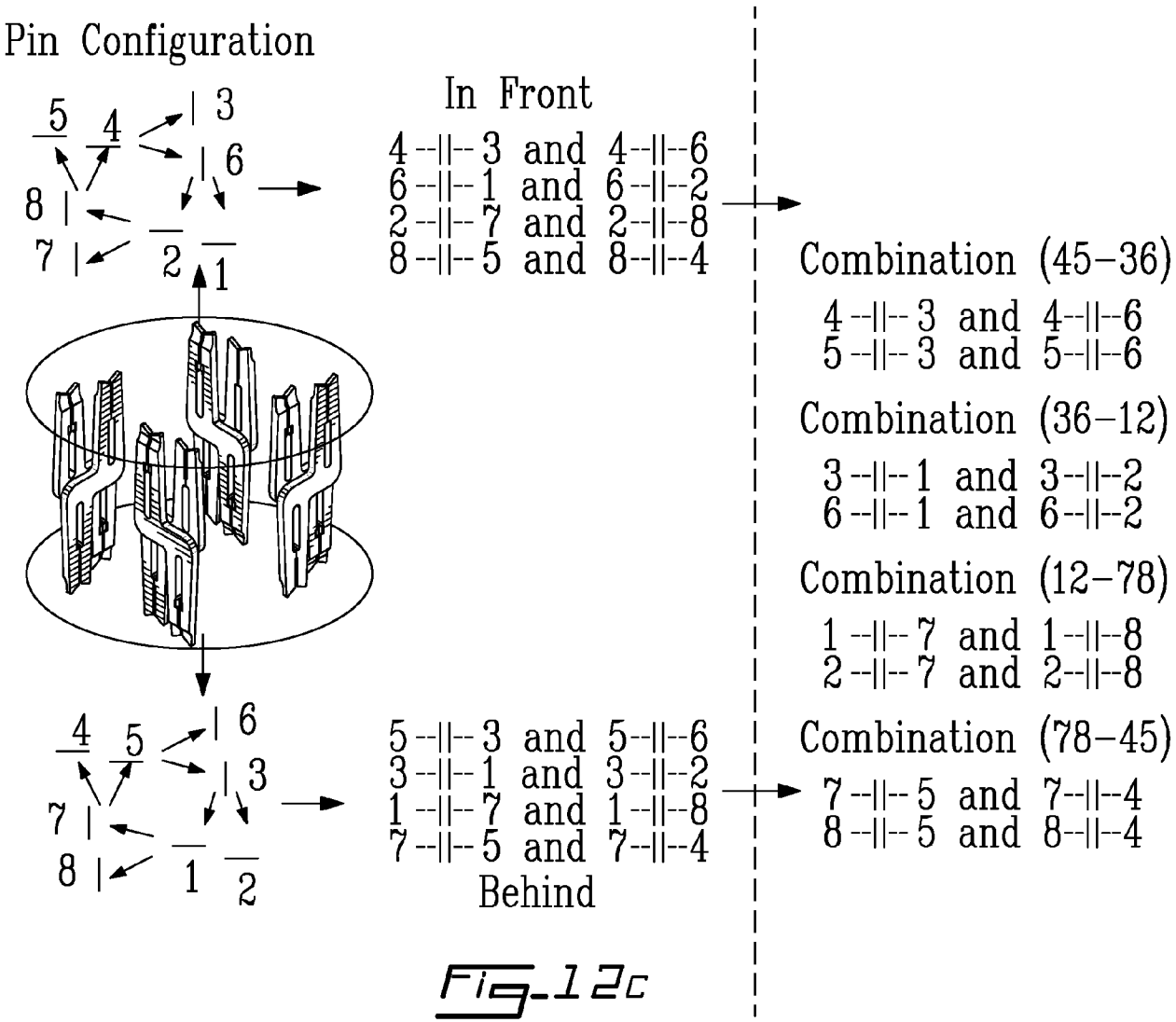

Referring now to FIG. 12(*a*), unraveling the twisted pairs of conductors 40 such that they may be inserted between the blades as in 34 of the bifurcated IDCs 28, 30 gives rise to a parasitic coupling, illustrated by capacitive elements $C_{P4\text{-}7}$, $C_{P4\text{-}8}$, $C_{P5\text{-}7}$ and $C_{P5\text{-}8}$, between the conductors as in 40 (again, illustratively the connecting elements as in 22 are indicated as terminating conductors $\mathbf{40}_4$, $\mathbf{40}_5$, $\mathbf{40}_7$ and $\mathbf{40}_8$ of the twisted pairs of conductors 40). Referring to FIG. 12(*b*) in addition to FIG. 12(*a*), due to the configuration of the parasitic capacitances $C_{P4\text{-}7}$, $C_{P4\text{-}8}$, $C_{P5\text{-}7}$ and $C_{P5\text{-}8}$, the resultant network inherently cancels differential mode to differential mode cross talk and differential mode to common mode cross talk.

As will now be apparent to a person of ordinary skill in the art, a differential signal travelling on conductors $\mathbf{40}_4$ and $\mathbf{40}_5$ will appear as equal and opposite signals on both conductors $40_7$ and $40_8$ which effectively cancel each other. Indeed, the positive phase of the differential signal carried on conductor $40_4$ is coupled by $C_{P4\text{-}7}$ and $C_{P4\text{-}8}$ onto both conductors $40_7$ and $40_8$. Similarly, the negative phase of the differential signal carried on conductor $40_5$ is coupled by $C_{P5\text{-}8}$ and $C_{P5\text{-}7}$ onto both conductors $40_7$ and $40_8$. As the parasitic capacitances are substantially equal and the lengths of the connecting elements as in 22 much less than the wavelength of the signal being transmitted (illustratively signals of 650 MHz having a wavelength of circa 0.46 meters), thereby resulting in only minimal shifts in phase, the differential signals coupled onto conductors $40_7$ and $40_8$ by the parasitic capacitances as cross talk will effectively cancel each other out.

Referring now to FIG. 12(*c*), given the geometric positioning of the connecting elements as in 22 relative to one another, the above parasitic coupling is repeated for all pairs of conductors terminated at the connecting elements as in 22. As a result, balancing is provided for all pairs of conductors interconnected via the four (4) pairs of connecting elements as in 22. Of note is that the balancing is provided regardless of the orientation of the conductors 40 in their interconnection with the connecting elements as in 22. That is, for example, the conductor designated 4 which as discussed above is generally referred as the Tip and conductor designated 5 which as discussed above is generally referred to as the Ring of that pair may be interchanged with one another (that is, terminated by the other connecting elements as in 22) without effecting the balancing. This applies equally to all pairs of conductors, that is as illustrated pairs 1-2, 3-6, 4-5 and 7-8.

Figure 13A:
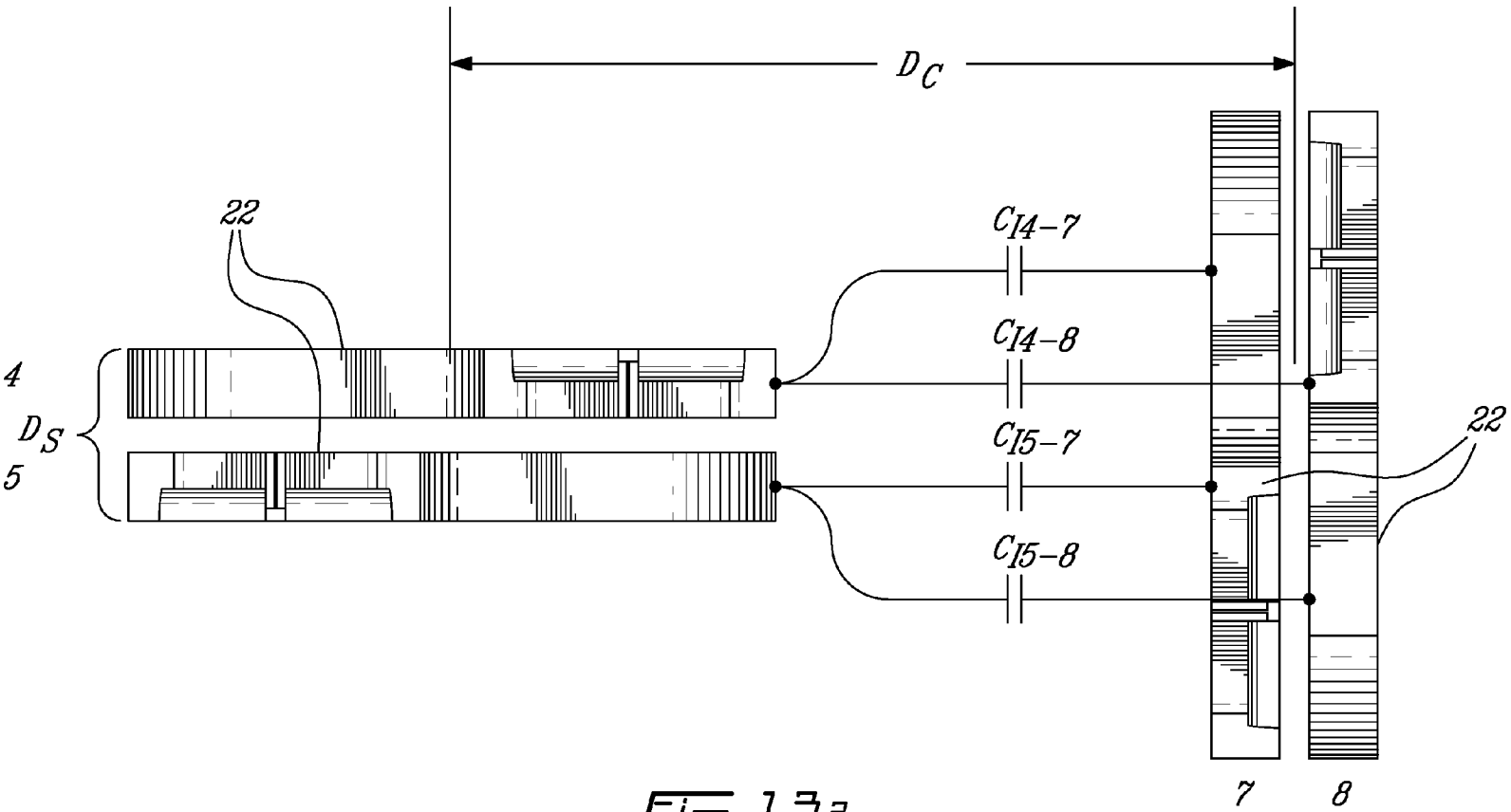
FIG. 13(*a*) is a top plan view of the two pairs of interconnectors of FIG. 12(*a*) detailing the inherent capacitances.
Figure 13B:
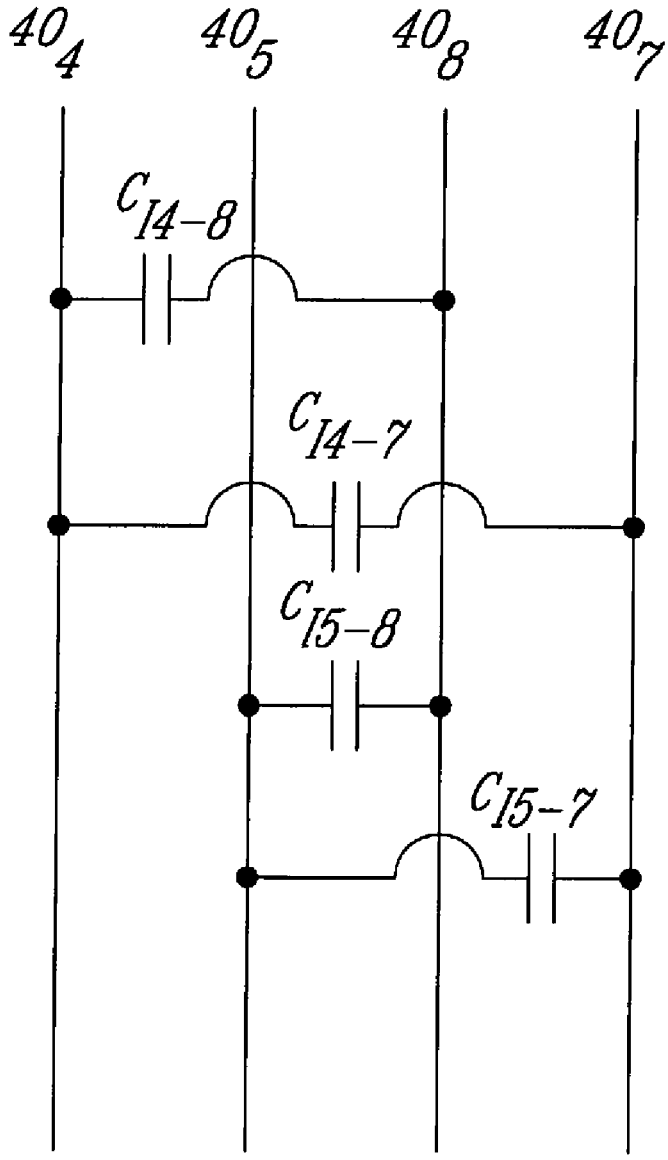

Referring now to FIG. 13(*a*), positioning of the connecting elements as in 22 also gives rise to an inherent capacitive coupling between connecting elements as in 22, illustrated by capacitive elements $C_{I4\text{-}7}$, $C_{I4\text{-}8}$, $C_{I5\text{-}7}$ and $C_{I5\text{-}8}$. Referring to FIG. 13(*b*) in addition to FIG. 13(*a*), provided distance $D_C$ between the centres of adjacent connecting elements as in 22 is substantially greater than the distance $D_S$ separating interconnectors terminating a particular pair of conductors (illustratively the distance D is about 10 times greater), these inherent capacitances are substantially equal and as a result form a capacitive network which inherently cancels differential mode to differential mode cross talk and differential mode to common mode cross talk. Of note is that the capacitive network formed by the inherent capacitances is essentially the same as that of the parasitic capacitances as discussed above in reference to FIGS. 12(*a*) through 12(*c*) and there the above discussion in reference to the parasitic capacitances can be applied to the inherent capacitances. Again, given the geometric interrelation between the connecting elements as in 22 of different pairs, a similar network of inherent capacitances is formed, depending on orientation, between adjacent pairs of connecting elements as in 22.

Figure 14A:
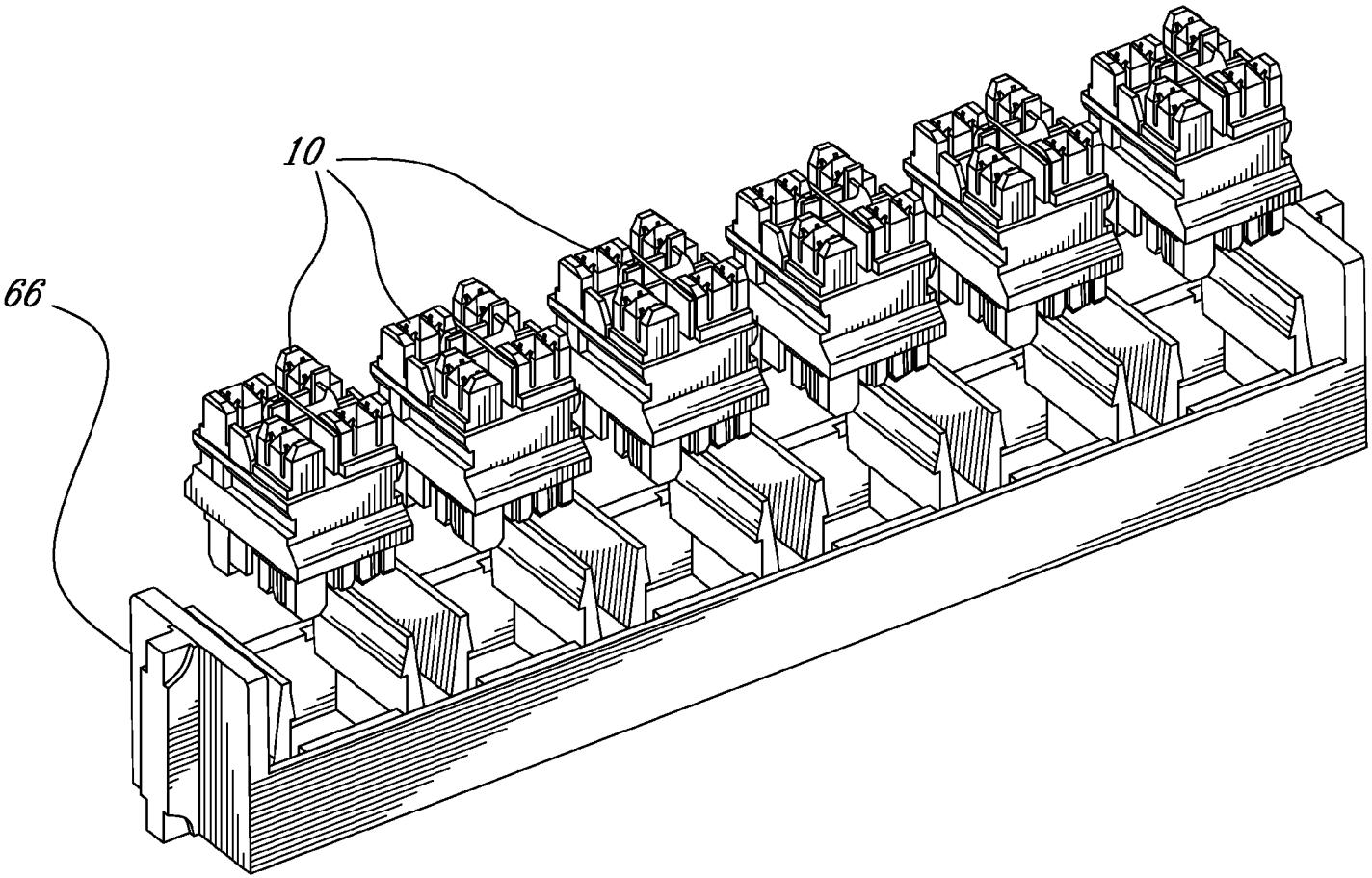
FIG. 14(*a*) is a raised perspective view of a plurality of balanced interconnectors and support frame in accordance with an alternative illustrative embodiment of the present invention.
Figure 14B:
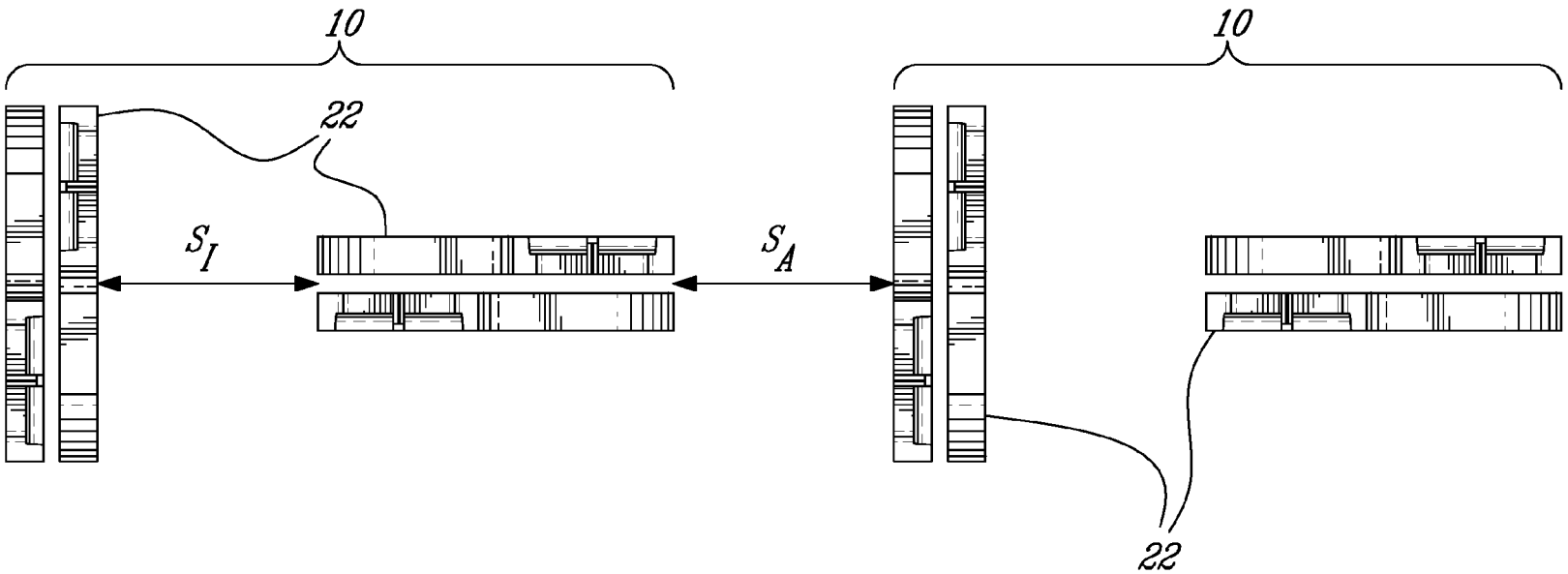

Referring now to FIG. 14(*a*), the cross connector 10 is illustratively modular and adapted for mounting, typically along with one or more like cross connectors as in 10, in a receptacle machined or otherwise formed in supporting frame 66, such as a patch bay panel or the like. In this regard, once the cross connectors as in 10 are mounted on the supporting frame, one set of turrets is exposed on each side of the supporting frame 66.

Referring now to FIG. 14(*b*) in addition to FIG. 14(*a*), provided the spacing between adjacent cross connectors as in 10 is chosen such the separation SA between pairs of connecting elements as in 22 of adjacent cross connectors as in 10 is at least the same as the separation $S_I$ between pairs of connecting elements as in 22 within a cross connector as in 10, the relative geometry between adjacent pairs of connecting elements as in 22 can be maintained between adjacent cross connector as in 10 such that the cross talk cancelling effect is achieved.

A person of skill in the art will understand that the present invention could also be used together with shielded conductors and cables, for example with the provision of a shielding cover (not shown) on the cross connector 10 manufactured for example from a conductive material and interconnected with the shielding material surrounding the conductors/cables.

Although the present invention has been described hereinabove by way of an illustrative embodiment thereof, this embodiment can be modified at will without departing from the spirit and nature of the subject invention.

What is claimed is:

1. A method of interconnecting first and second conductors of a first pair of conductors respectively with first and second conductors of a second pair of conductors and first and second conductors of a third pair of conductors respectively with first and second conductors of fourth second pair of conductors, the second conductor of the first pair of conductors coupled by a first parasitic capacitance to the first conductor of the third pair of conductors and the first conductor of the second pair of conductors coupled by a second parasitic capacitance to the second conductor of the fourth pair of conductors, wherein the first and second parasitic capacitances are substantially the same, the method comprising:

providing first and second interconnecting elements;

providing a first capacitor having a capacitive value substantially the same as the parasitic capacitances;

coupling said first and second elements with said first capacitor;

interconnecting said first element between the first conductor of the first pair of conductors and the first conductor of the second pair of conductors and said second element between the first conductor of the third pair of conductors and the first conductor of the fourth pair of conductors;

providing third and fourth interconnecting elements;

providing a second capacitor having a capacitive value substantially the same as the parasitic capacitances;

coupling said third and fourth elements with said second capacitor;

interconnecting said third element between the second conductor of the first pair of conductors and the second conductor of the second pair of conductors and said fourth element between the second conductor of the third pair of conductors and the second conductor of the fourth pair of conductors.

2. The method of claim 1, wherein said first and second elements are Tip elements and wherein said third and fourth elements are Ring elements.

3. The method of claim 1, wherein said first capacitor providing act comprises positioning said first and second elements relative to one another such that an outer edge of said first element acts as a first electrode of said first capacitor, an outer edge of said second element acts as a second electrode of said first capacitor and air in between said first element outer edge and said second element outer edge acts as a dielectric of said first capacitor.

4. The method of claim 1, wherein said second capacitor providing act comprises positioning said third and fourth elements relative to one another such that an outer edge of said third element acts as a first electrode of said second capacitor, an outer edge of said fourth element acts as a second electrode of said second capacitor and air in between said third element outer edge and said fourth element outer edge acts as a dielectric of said second capacitor.

5. The method of claim 1, wherein the pairs of conductors are twisted pairs of conductors.

6. The method of claim 1, wherein each of the first conductors is a Tip conductor and each of the second conductors is a Ring conductor.

7. An interconnector for interconnecting first and second conductors of a first pair of conductors with first and second conductors of a second pair of conductors and first and second conductors of a third twisted pair of conductors with first and second conductors of a fourth twisted pair of conductors, the second conductor of the first pair of conductors coupled by a first parasitic capacitance to the first conductor of the third pair of conductors and the first conductor of the second pair of conductors coupled by a second parasitic capacitance to the second conductor of the fourth pair of conductors, wherein the first and second parasitic capacitances are substantially the same, the interconnector comprising:

first and second Tip elements, said first Tip element interconnected between the first conductor of the first pair of conductors and the first conductor of the second pair of conductors and said second Tip element interconnected between the first conductor of the third pair of conductors and the first conductor of the fourth pair of conductors;

first and second Ring elements, said first Ring element interconnected between the second conductor of the first pair of conductors and the second conductor of the second pair of conductors and said second Ring element interconnected between the second conductor of the third pair of conductors and the second conductor of the fourth pair of conductors; and first and second capacitors between respectively said first and second Tip elements and said first and second Ring elements;

wherein each of said capacitors is substantially equal to the first and second parasitic capacitances.

8. The interconnector of claim 7, wherein each of said elements comprises a first terminal positioned towards a first end and a second terminal positioned towards a second end and further wherein each conductor of the first set of conductors is terminated at a respective one of said first terminals and each conductor of the second set of conductors is terminated at a respective one of said second terminals.

9. The interconnector of claim 8, wherein each pair of the first set of two pairs of conductors and the second set of two pairs of conductors is a twisted pair of conductors and further wherein each of said terminals comprises an IDC.

10. The interconnector of claim 8, wherein each of said terminals is elongate and further wherein each of said terminals is arranged along parallel non-collinear axes.

11. The interconnector of claim 10, wherein each of said elements comprises an elongate connecting portion between said terminals, said connecting portion arranged substantially at right angles to said terminals.

12. The interconnector of claim 7, wherein for each pair of elements, said Tip element is arranged opposite said Ring element as a reverse mirror image.

13. The interconnector of claim 7, wherein said first capacitive coupling is between said Ring element of said first pair of elements and said Tip element of said second pair of elements, said second capacitive coupling is between said Ring element of said second pair of elements and said Tip element of said first pair of elements, said third capacitive coupling is between said Tip element of said first pair of elements and said Tip element of said second pair of elements, and said fourth capacitive coupling is between said Ring element of said first pair of elements and said Ring element of said second pair of elements.

14. The interconnector of claim 7, wherein an outer edge of said first Tip element forms a first electrode of said first capacitor, an outer edge of said second Tip element forms a second electrode of said first capacitor and air in between said first Tip element outer edge and said second Tip element outer edge forms a dielectric of said first capacitor.

15. The interconnector of claim 7, wherein an outer edge of said first Ring element forms a first electrode of said second capacitor, an outer edge of said second Ring element forms a second electrode of said second capacitor and air in between said first Ring element outer edge and said second Ring element outer edge forms a dielectric of said second capacitor.

16. The interconnector of claim 8, wherein each of the first conductors is a Tip and each of the second conductors is a Ring.

17. The interconnector of claim 16, wherein each of said elements comprises an elongate connecting portion between said terminals, said connecting portion arranged substantially at right angles to said terminals, wherein a substantially flat end of said connecting portion of a first of said Tip elements facing a second of said Tip elements and a substantially flat end of said connecting portion of a said second Tip element facing said first Tip element are arranged opposite one another and in parallel and wherein a substantially flat end of said connecting portion of a first of said Ring elements facing a second of said Ring elements and a substantially flat end of said connecting portion of a said second Ring element facing said first Ring element are arranged opposite one another and in parallel.

* * * * *